US009841216B2

(12) United States Patent
Matsumoto

(10) Patent No.: US 9,841,216 B2
(45) Date of Patent: Dec. 12, 2017

(54) INDOOR UNIT OF AIR-CONDITIONING APPARATUS

(71) Applicant: Mitsubishi Electric Corporation, Tokyo (JP)

(72) Inventor: Takashi Matsumoto, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 617 days.

(21) Appl. No.: 14/470,003

(22) Filed: Aug. 27, 2014

(65) Prior Publication Data

US 2015/0096318 A1 Apr. 9, 2015

(30) Foreign Application Priority Data

Oct. 4, 2013 (JP) ..... 2013-208801

(51) Int. Cl.

| | |
|---|---|
| ***F25D 17/04*** | (2006.01) |
| ***F25B 49/00*** | (2006.01) |
| ***F24F 11/00*** | (2006.01) |
| ***F25D 17/06*** | (2006.01) |

(52) U.S. Cl.

CPC ..... *F25B 49/00* (2013.01); *F24F 11/0034* (2013.01); *F24F 11/0078* (2013.01); *F25D 17/06* (2013.01); *F24F 2011/0035* (2013.01); *F24F 2011/0057* (2013.01); *F24F 2011/0068* (2013.01); *F25B 2600/00* (2013.01)

(58) Field of Classification Search

CPC ..... F24F 11/0078; F24F 11/0034; F24F 2011/0035; F24F 2011/0057; F24F 2011/0068; F25D 17/06

See application file for complete search history.

(56) References Cited

U.S. PATENT DOCUMENTS 5,331,825 A * 7/1994 Kim ..... F24F 11/0034 236/51
7,881,827 B2 * 2/2011 Park ..... F24F 11/0034 236/51
2013/0255909 A1 10/2013 Matsumoto

FOREIGN PATENT DOCUMENTS

| | | | |
|---|---|---|---|
| CN | 101571302 | A * | 11/2009 |
| CN | 103196182 | A | 7/2013 |
| EP | 2 615 386 | A2 | 7/2013 |
| JP | H03247939 | A * | 11/1991 |
| JP | H0452444 | A * | 2/1992 |
| JP | 06-323599 | A | 11/1994 |

(Continued)

OTHER PUBLICATIONS

Hattori et al., Duct Air Conditioner, Feb. 20, 1992, JPH0452444A, Whole Document.*

(Continued)

*Primary Examiner* — Larry Furdge
(74) *Attorney, Agent, or Firm* — Posz Law Group, PLC

(57) ABSTRACT

An indoor unit of an air-conditioning apparatus includes a controller that controls a refrigeration cycle, an up/down air flow direction plate, and a left/right air flow direction plate, based on information of a person whose image is captured by an imaging device. When the refrigeration cycle is stopped, in a case where the face of the person detected by the imaging device remains stationarily facing the imaging device for a preset recognition time, the controller recognizes the person as one wishing the refrigeration cycle to be activated, and activates the refrigeration cycle.

17 Claims, 12 Drawing Sheets

(56) References Cited

FOREIGN PATENT DOCUMENTS

| | | | |
|---|---|---|---|
| JP | 06-337154 | A | 12/1994 |
| JP | 2006-220405 | A | 8/2006 |
| JP | 2013-155922 | A | 8/2013 |
| JP | 2013-164253 | A | 8/2013 |
| JP | 2013-183423 | A | 9/2013 |
| JP | 2013-190203 | A | 9/2013 |

OTHER PUBLICATIONS

Kikumoto, Air Conditioning Unit, Nov. 6, 1991, JPH03247939A, Whole Document.*

Bak et al., Air Conditioner and Action Method thereof, Nov. 4, 2009, CN101571302A, Whole Document.*

Extended European Search Report dated Feb. 23, 2015 issued in corresponding EP patent application No. 14181090.3.

Office Action dated Jan. 19, 2016 in the corresponding JP application No. 2013-208801 (with English translation).

Extended European Search Report dated Mar. 14, 2016 issued in corresponding EP patent application No. 15191894.3.

Office Action dated Oct. 27, 2016 issued in corresponding CN patent application No. 201410514457.4 (and English translation).

* cited by examiner

INDOOR UNIT OF AIR-CONDITIONING APPARATUS

CROSS REFERENCE TO RELATED APPLICATION

This application is based on Japanese Application No. 2013-208801, filed on Oct. 4, 2013, the disclosure of which is incorporated herein by reference.

TECHNICAL FIELD

The present invention relates to an indoor unit of an air-conditioning apparatus, and more specifically, to an indoor unit of an air-conditioning apparatus capable of changing the blowing direction of conditioned air.

BACKGROUND

Hitherto, an indoor unit of an air-conditioning apparatus (hereinafter, referred to as an "indoor unit") which detects the location of a person who is present in a room (hereinafter, referred to as a "person-in-room") and which blows air in a manner which avoids the person-in-room or, on the contrary, in a manner which blows air toward the person-in-room, in order to enhance the comfort of the person-in-room, has been known.

The indoor unit not only detects the location of a person-in-room but also detects the activity state of the person-in-room and controls the temperature, the amount, and the blowing direction of conditioned air, based on the activity state. That is, an indoor unit is disclosed in which when the indoor unit detects that the amount of activity of the person-in-room (hereinafter, referred to as a "user") has increased due to light exercise or light labor, air is intensively blown to the user to remove the amount of heat generated by the activity, so that an increase in the body temperature of the user is suppressed and therefore the user does not feel hot (for example, see Patent Literature 1).

PATENT LITERATURE

[Patent Literature 1] Japanese Unexamined Patent Application Publication No. 6-323599 (Pages 3 to 5, FIG. 2)

The indoor unit disclosed in Patent Literature 1 is configured to intensively blow air toward the user when an increase in the amount of activity along with an activity is detected. Therefore, since the amount of activity is small at a time immediately after a user takes a bath or immediately after a user enters a room from hot (or cold) outdoors, a demand of wanting to temporarily and quickly feel cool (or warm) immediately after taking a bath or immediately after entering a room from hot (or cold) outdoors cannot be met.

Furthermore, since it is necessary to operate a remote controller or the like to activate an indoor unit (refrigeration cycle) and to adjust the blowing direction of conditioned air immediately after taking a bath or immediately after entering a room from hot (or cold) outdoors, complicated operations, such as looking for the remote controller and operating the remote controller or the like, are required. Therefore, the above-mentioned demand cannot be met quickly.

It is further necessary to operate the remote controller or the like to stop air-blowing (refrigeration cycle) when the user feels cool enough (or warm enough), which makes operations cumbersome.

SUMMARY

The present invention meets the above-mentioned demand and obtains an indoor unit of an air-conditioning apparatus that attains at least one of a first object of easily and quickly activating a refrigeration cycle without requiring an operation on a remote controller or the like, a second object of easily and quickly directing the blowing direction of conditioned air toward a person who wishes to receive conditioned air, without requiring an operation on a remote controller or the like, a third object of easily and quickly stopping air-blowing (refrigeration cycle) without requiring an operation on a remote controller or the like when a person feels cool enough (or warm enough), and a fourth object of easily finding a remote controller when a person has trouble finding the remote controller.

An indoor unit of an air-conditioning apparatus according to the present invention includes a heat exchanger that performs part of a refrigeration cycle, an imaging device that captures an image of a room, and a controller that controls at least the refrigeration cycle, based on information of a person whose image is captured by the imaging device. When the refrigeration cycle is stopped, in a case where a face of the person whose image is captured by the imaging device remains stationarily facing the imaging device for a preset recognition time, the controller activates the refrigeration cycle.

With the indoor unit of the air-conditioning apparatus according to the present invention, when the face of the person remains stationarily facing the imaging device for the preset recognition time, the refrigeration cycle is activated. Therefore, the person is able to activate the refrigeration cycle easily and quickly without performing an operation on the remote controller or the like.

That is, for example, if a user (person) who has just taken a bath or just entered the room from hot or cold outdoors is located within a visual field of the imaging device, only by allowing the face of the person to face the indoor unit only for at least the recognition time, as long as the person is located inside the room, the refrigeration cycle can be activated. Therefore, the time and effort for looking for the remote controller and operating the remote controller can be saved, and convenience is thus improved.

DETAILED DESCRIPTION

Embodiment 1

Figure 1A:
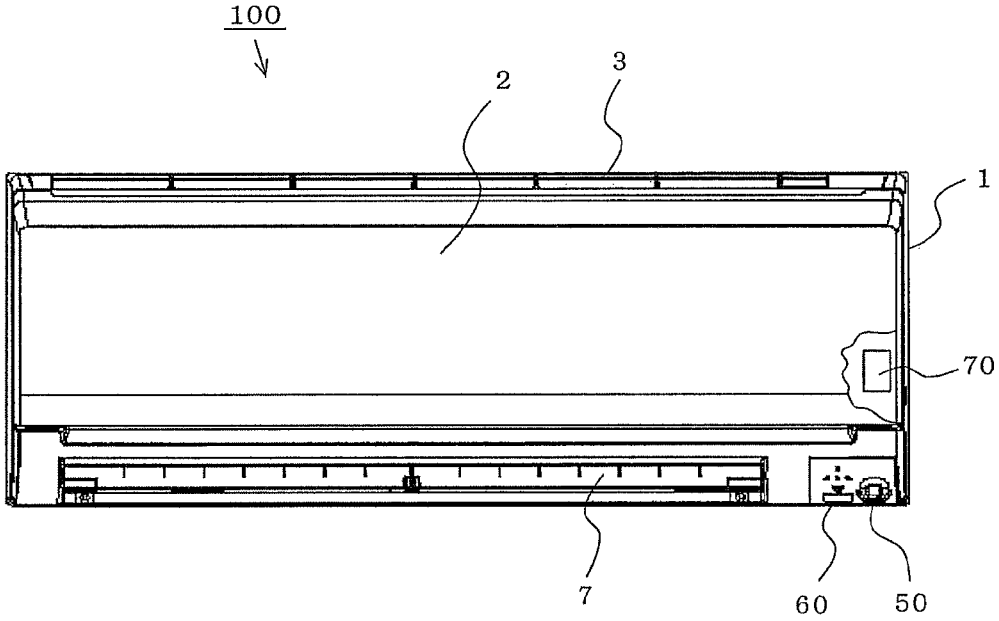
FIG. 1A is a front view for explaining an indoor unit of an air-conditioning apparatus according to Embodiment 1 of the present invention, and shows an indoor unit main body.
Figure 1B:
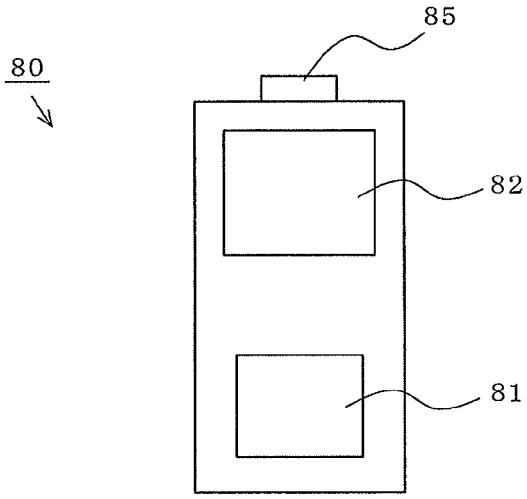
FIG. 1B is a front view for explaining the indoor unit of the air-conditioning apparatus according to Embodiment 1 of the present invention, and shows a remote controller.
Figure 2:
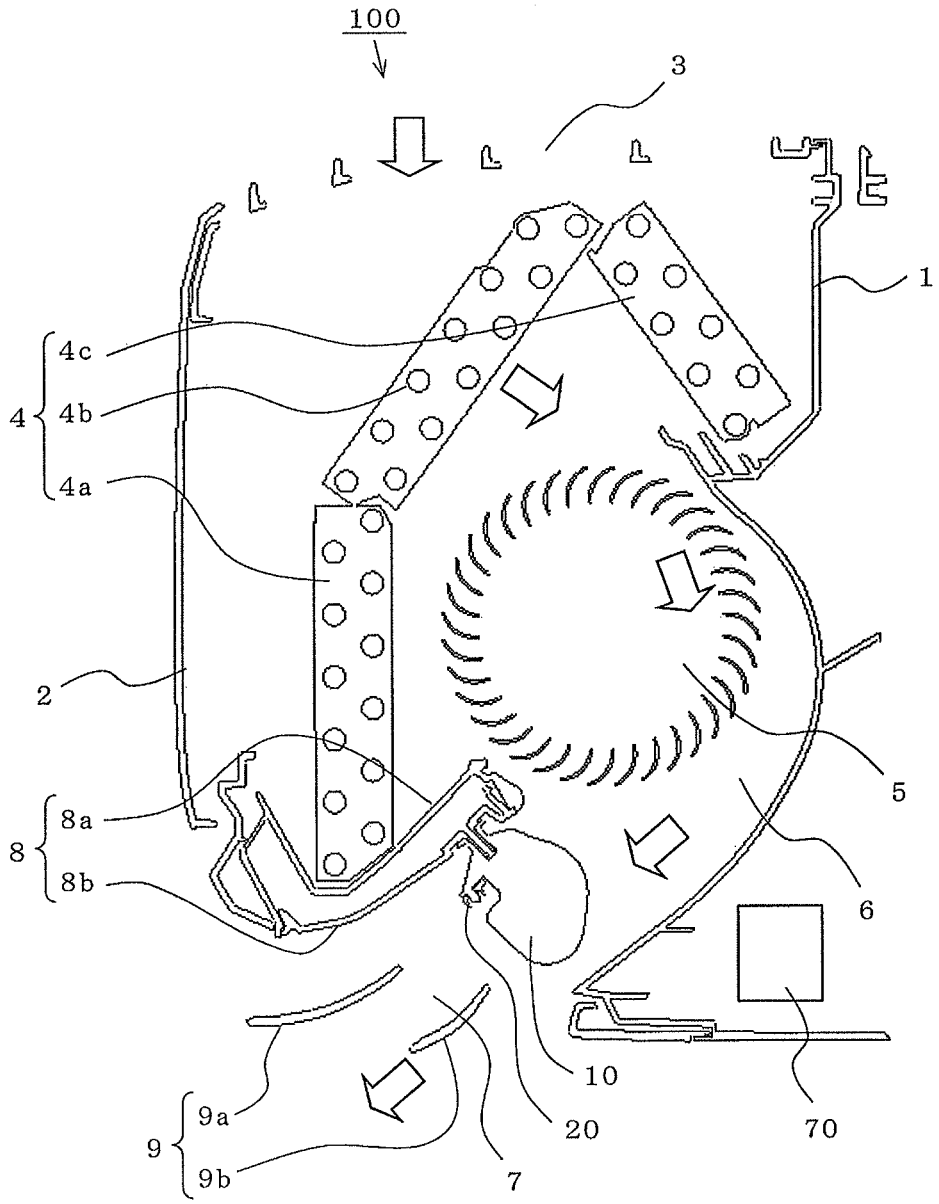
FIG. 2 is a sectional side view of the indoor unit main body illustrated in FIG. 1A.
Figure 3:
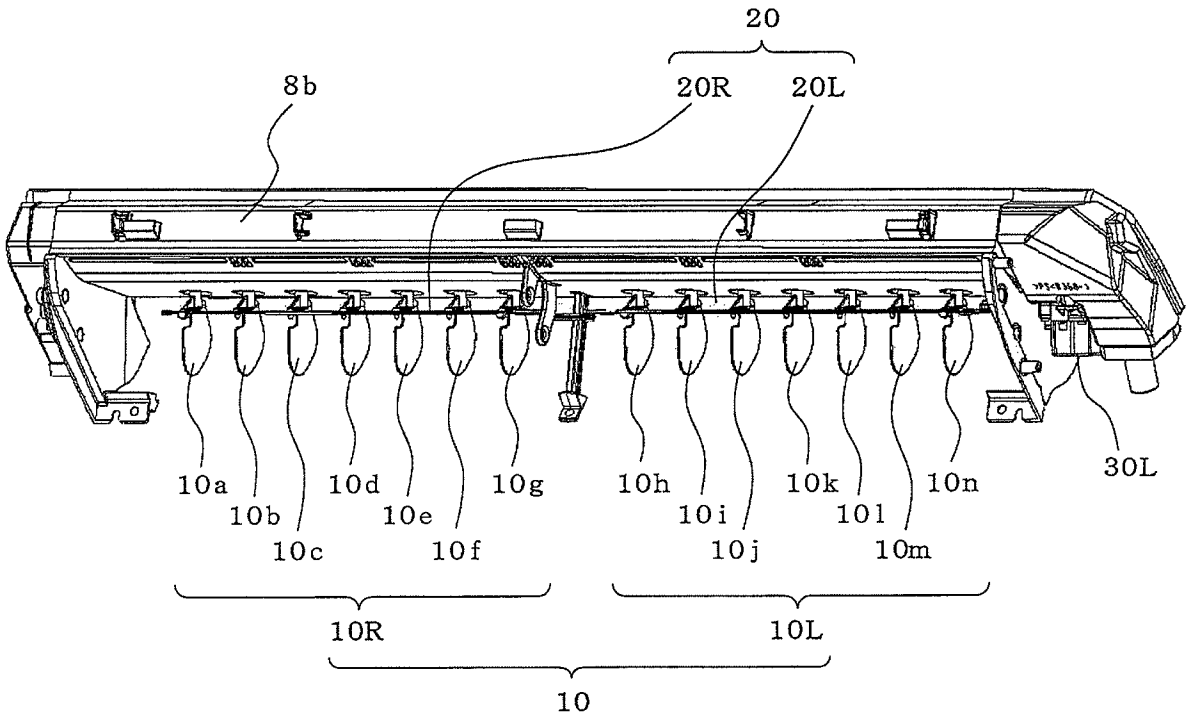
FIG. 3 is a perspective view of an extracted part (near an air outlet) of the indoor unit main body illustrated in FIG. 1A.

FIGS. 1 to 3 illustrate an indoor unit of an air-conditioning apparatus according to Embodiment 1 of the present invention. FIG. 1A is a front view of an indoor unit main body. FIG. 1B is a front view of a remote controller provided in the indoor unit. FIG. 2 is a sectional side view of the indoor unit main body. FIG. 3 is a perspective view of an extracted part (near an air outlet) of the indoor unit. Each of the figures is schematically rendered, and the present invention is not limited to the forms illustrated in the figures.

(Main Body)

Referring to FIG. 1A, an indoor unit of an air conditioning apparatus (hereinafter, referred to as an "indoor unit") 100 includes a main body 1 that has an air inlet 3 formed in an upper part thereof and an air outlet 7 formed in a lower part thereof, a front panel 2 that covers the front side of the main body 1 in such a manner that the front side can be covered or uncovered freely, a fan 5 that sucks indoor air through the air inlet 3 and forms an air path 6 which reaches the air outlet 7, and a heat exchanger 4 that is installed on an upstream side (near the air inlet 3) of the fan 5.

A main body communication device 60 that receives a signal from a remote controller 80 and an imaging device 50 that captures an image of an indoor state are installed beside the air outlet 7 on the front side of the main body 1.

In the present invention, the type and the installation location of the main body communication device 60 and the imaging device 50 are not limited. For example, the main body communication device 60 and the imaging device 50 may be installed at the center of the front panel 2 or the like. Furthermore, a reporting device (not illustrated) that reports the operation status of the indoor unit 100 using a sound or image is provided on the main body 1 or the remote controller (not illustrated).

The heat exchanger 4, which performs part of a refrigeration cycle, includes a heat exchange front portion 4*a*, which is a portion that is substantially parallel to the front panel 2, a heat exchange upper front portion 4*b*, which is a portion that is diagonally upper near the front side of the fan 5, and a heat exchange upper rear portion 4*c*, which is a portion that is diagonally upper near the rear side of the fan 5. A drain pan 8 is arranged below the heat exchange front portion 4*a*. An upper surface 8*a* of the drain pan 8 forms a drain pan surface that actually receives drain, and a lower surface 8*b* of the drain pan 8 forms a front side of the air path 6.

(Air Flow Direction Adjusting Device)

A left-side left/right air flow direction plate group 10L and a right-side left/right air flow direction plate group 10R (collectively or individually referred to as a "left/right air flow direction plate 10") that adjust the horizontal (left/right) blowing direction of indoor air conditioned at the heat exchanger 4 (hereinafter, referred to as "conditioned air") are arranged in the air path near the air outlet 7. An up/down air flow direction plate 9 (a front up/down air flow direction plate 9*a* and a rear up/down air flow direction plate 9*b* are collectively referred to as an "up/down air flow direction plate 9") that adjusts the vertical (up/down) blowing direction of conditioned air is arranged at the air outlet 7, which is located at the end of the air path 6. The left/right air flow direction plate 10 and the up/down air flow direction plate 9 function as an air flow direction adjusting device.

The "left-side" plate and the "right-side" plate represent, for convenience, a plate that can be viewed on the left-hand side and a plate that can be viewed on the right-hand side, respectively, when the room is viewed from the indoor unit 100, that is, when the direction toward the front panel 2 is viewed from the rear side of the main body 1.

(Left/Right Air Flow Direction Plate)

Referring to FIG. 3, the right-side left/right air flow direction plate group 10R includes left/right air flow direction plates 10*a*, 10*b*, . . . , and 10*g*. The right-side left/right air flow direction plate group 10R is rotatably arranged at the lower surface 8*b* of the drain pan 8 and is connected to a right-side connecting bar 20R. The left-side left/right air flow direction plate group 10L includes left/right air flow direction plates 10*h*, 10*i*, . . . , and 10*n* and is connected to a left-side connecting bar 20L.

The right-side left/right air flow direction plate group 10R and the right-side connecting bar 20R form a link mechanism, and the left-side left/right air flow direction plate group 10L and the left-side connecting bar 20L form a link mechanism. A right-side driving unit (not illustrated) is connected to the right-side connecting bar 20R, and a left-side driving unit 30L is connected to the left-side connecting bar 20L.

Accordingly, when the right-side connecting bar 20R is translated by the right-side driving unit, the left/right air flow direction plates 10*a*, 10*b*, . . . , and 10*g* move rotationally while keeping parallel to one another. Furthermore, when the left-side connecting bar 20L is translated by the left-side driving unit 30L, the left/right air flow direction plates 10*h*, 10*i*, . . . , and 10*n* move rotationally while keeping parallel to one another. Thus, conditioned air can be blown in the same direction over the entire width of the air outlet 7, conditioned air can be blown in opposite directions between one half and the other half of the width of the air outlet 7, the directions being away from each other, or conditioned air can be blown in opposite directions between one half and the other half of the width of the air outlet 7, the directions colliding with each other.

In the present invention, the left/right air flow direction plate 10 is not limited by the illustrated form. The number of plates of the left/right air flow direction plate 10 is not particularly limited. Furthermore, the left/right air flow direction plate 10 may be divided into three or more groups. In this case, the individual groups may be rotatably connected to corresponding connecting bars, and the connecting bars may be translated independently.

(Up/Down Air Flow Direction Plate)

The up/down air flow direction plate 9 has a rotational center that is parallel to a horizontal direction and is rotatably arranged at the main body 1. The rotational axis of the front up/down air flow direction plate 9*a* and the rotational axis of the rear up/down air flow direction plate 9*b* are connected by a link mechanism or a gear mechanism and are moved rotationally by a common driving motor.

In the present invention, the up/down air flow direction plate 9 is not limited by the illustrated from. The front up/down air flow direction plate 9*a* and the rear up/down air flow direction plate 9*b* may be moved rotationally by different driving motors. Furthermore, the front up/down air flow direction plate 9*a* and the rear up/down air flow direction plate 9*b* may each be divided at the center thereof in the left/right direction, and the divided four plates may be moved rotationally in an independent manner.

(Remote Controller)

Referring to FIG. 1B, the remote controller 80 transmits an operation signal to the main body 1 (a main body communication device 60) and receives operation information from the main body 1. The remote controller 80 includes an input unit 81 that receives an operation signal input by a person (user), a display unit 82 that displays the received operation signal or the operation information received from the main body 1, and a communication unit 85 that allows communication with the main body 1.

(Recognition of Human Face)

Figure 4A:
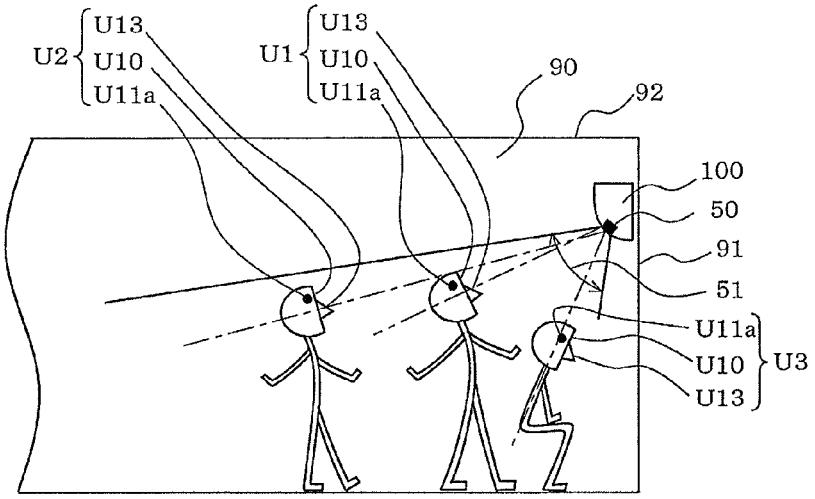
FIG. 4A is a side view illustrating a procedure of recognition of a human face by the indoor unit illustrated in FIG. 1A.
Figure 4B:
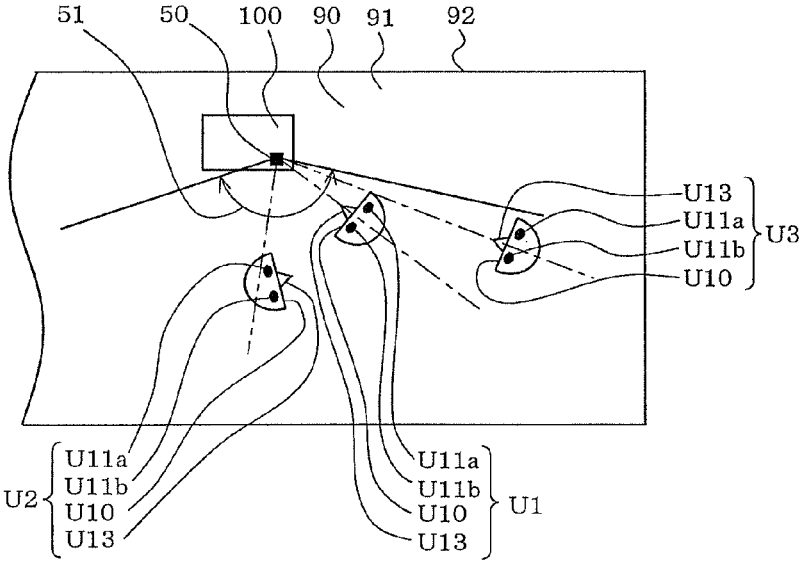
FIG. 4B is a plan view illustrating the procedure of recognition of the human face by the indoor unit illustrated in FIG. 1A.
Figure 5A:
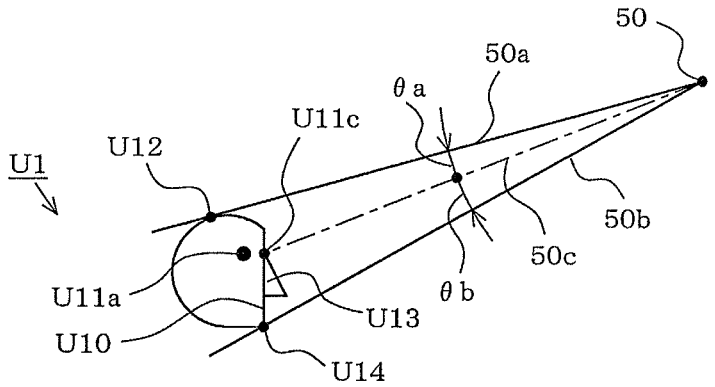
FIG. 5A is a side view illustrating a procedure of recognition of a human face by the indoor unit illustrated in FIG. 1A.
Figure 5B:
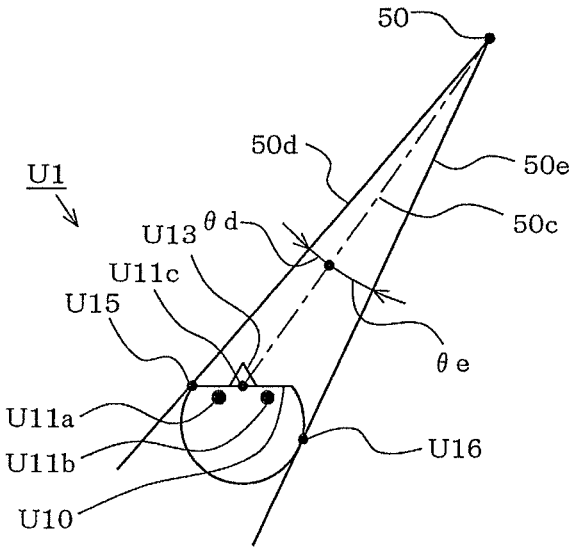
FIG. 5B is a plan view illustrating the procedure of recognition of the human face by the indoor unit illustrated in FIG. 1A.

FIGS. 4 and 5 are diagrams for illustrating procedures of recognition of a human face by the indoor unit of the air-conditioning apparatus according to Embodiment 1 of the present invention. FIG. 4A and FIG. 5A are schematic side views, and FIG. 4B and FIG. 5B are schematic plan views.

Referring to FIG. 4A and FIG. 4B, the indoor unit 100 is installed at a position on a wall (hereinafter, referred to as a "back-side wall") 91 of a room 90 near a ceiling surface 92. The imaging device 50 (for example, a CCD camera having 300 thousand pixels) has an obliquely downward visual field 51. The spread angle of the visual field 51 differs between the vertical direction and the horizontal direction, and the visual field 51 has a substantially elliptical cone shape.

A user U1 who is located within the visual field 51 is a person who is recognized by a controller 70 as a "person who wishes the refrigeration cycle to be activated (to start operation)". Meanwhile, each of a user U2 and a user U3 is not recognized by the controller 70 as a "person who wishes the refrigeration cycle to be activated (to start operation)".

That is, the user U1 remains stationarily with a face U10 of the user U1 facing the imaging device 50 for a preset recognition time J1 (for example, three seconds).

The term "facing" represents a state in which, on a horizontal plane, the angle formed by a radial line (expressed by a dashed line) from the imaging device 50 and a virtual line connecting an eye U11*a* and an eye U11*b* is a vertical angle, and on a vertical plane, the angle formed by a radial line (expressed by a dashed line) from the imaging device 50 and a virtual line connecting the forehead and the chin (a plane in the case where it is assumed that a face part except the nose is a plane) is a vertical angle. However, these angles are not limited to strictly vertical angles. These angles are approximately "90 degrees±20 degrees". In actuality, it is not easy to obtain the angle formed by the radial line and a virtual line. Therefore, determination as to a facing state is made based on a different method, instead of based on such an angle (the different method will be explained in detail separately).

Furthermore, the term "stationarily" does not necessarily literally represent an absolutely still state. The term "stationarily" also includes a state in which a shake occurs in a way in which an image of a face captured before the shake occurs and an image of the face captured at the time when the shake occurs partially overlap.

Specifically, in a captured image of the user U1, images of both eyes, the eye U11*a* and the eye U11*b*, which sandwich a nose U13 of the face U10 therebetween, are captured, and therefore the user U1 faces the imaging device 50 when viewed in the horizontal view. Further, the virtual line connecting the eye U11*a* and the eye U11*b* is located in an upper part of the face U10, and therefore the user U1 faces the imaging device 50 when viewed in the side view. Further, the midpoint of the virtual line connecting the eye U11*a* and the eye U11*b* is located at substantially the center of the face U10 (including the head), and therefore the user U1 faces the imaging device 50 when viewed in the plan view.

The user U2 faces the imaging device 50 when viewed in the side view. However, although an image of the eye U11*a* of the face U10 is captured, an image of the eye U11*b* is not captured since the eye U11*b* is hidden behind the nose U13. Therefore, it is determined that the user U2 is looking the other way and the user U2 does not face the imaging device 50 when viewed in the plan view.

The user U3 faces the imaging device 50 when viewed in the plan view. However, the midpoint of the virtual line connecting the eye U11*a* and the eye U11*b* is located below the center of the face U10 (including the head). Therefore, the user U3 does not face the imaging device 50 when viewed in the side view.

(Facing when Viewed in Side View)

Next, regarding determination as to "facing", facing when viewed in the side view and facing when viewed in the plan view will be explained.

In FIG. 5A, in a captured image of the user U1, both eyes, the eye U11*a* and the eye U11*b*, of the user U1 are recognized. Further, the midpoint of the virtual line connecting the eye U11*a* and the eye U11*b* is represented by a midpoint U11*c*, and a radial line from the imaging device 50 passing through the midpoint U11*c* is represented by a radial line 50*c*. Furthermore, in the captured image of the user U1, an upper end of the face U10 (including the head) is represented by an upper end U12, and a radial line from the imaging device 50 passing through the upper end U12 is represented by a radial line 50*a*. Meanwhile, in the captured image of the user U1, a lower end of the face U10 (equal to the lower end of the chin) is represented by a lower end U14, and a radial line from the imaging device 50 passing through the lower end U14 is represented by a radial line 50*b*.

An angle θa formed by the radial line 50*a* and the radial line 50*c* is compared with an angle θb formed by the radial line 50*b* and the radial line 50*c*. When the difference between the angle θa and the angle θb ($\Delta\theta ab=|\theta a-\theta b|$) is small, it is assumed that the user U1 faces the imaging device 50 when viewed in the side view. The value of the difference between the angle θa and the angle θb (Δθab) is not particularly limited. However, the value is set to about "20 degrees".

(Facing when Viewed in Plan View)

In FIG. 5B, in a captured image of the user U1, both eyes, the eye U11*a* and the eye U11*b*, of the user U1 are recognized. Further, the midpoint of the virtual line connecting the eye U11*a* and the eye U11*b* is represented by a midpoint U11*c*, and a radial line from the imaging device 50 passing through the midpoint U11*c* is represented by a radial line 50*c*. Furthermore, in the captured image of the user U1, one side end of the face U10 (including the head) is represented by a left end U15, and a radial line from the imaging device 50 passing through the left end U15 is represented by a radial line 50*d*. Moreover, in the captured image of the user U1, the other side end of the face U10 (including the head) is represented by a right end U16, and a radial line from the imaging device 50 passing through the right end U16 is represented by a radial line 50*e*.

An angle θd formed by the radial line 50*d* and the radial line 50*c* is compared with an angle θe formed by the radial line 50*e* and the radial line 50*c*. When the difference between the angle θd and the angle θe ($\Delta\theta de=|\theta d-\theta e|$) is small, it is assumed that the user U1 faces the imaging device 50 when viewed in the plan view. The value of the difference between the angle θd and the angle θe (Δθde) is not particularly limited. However, the value is set to about "20 degrees".

(Controller)

Figure 6:
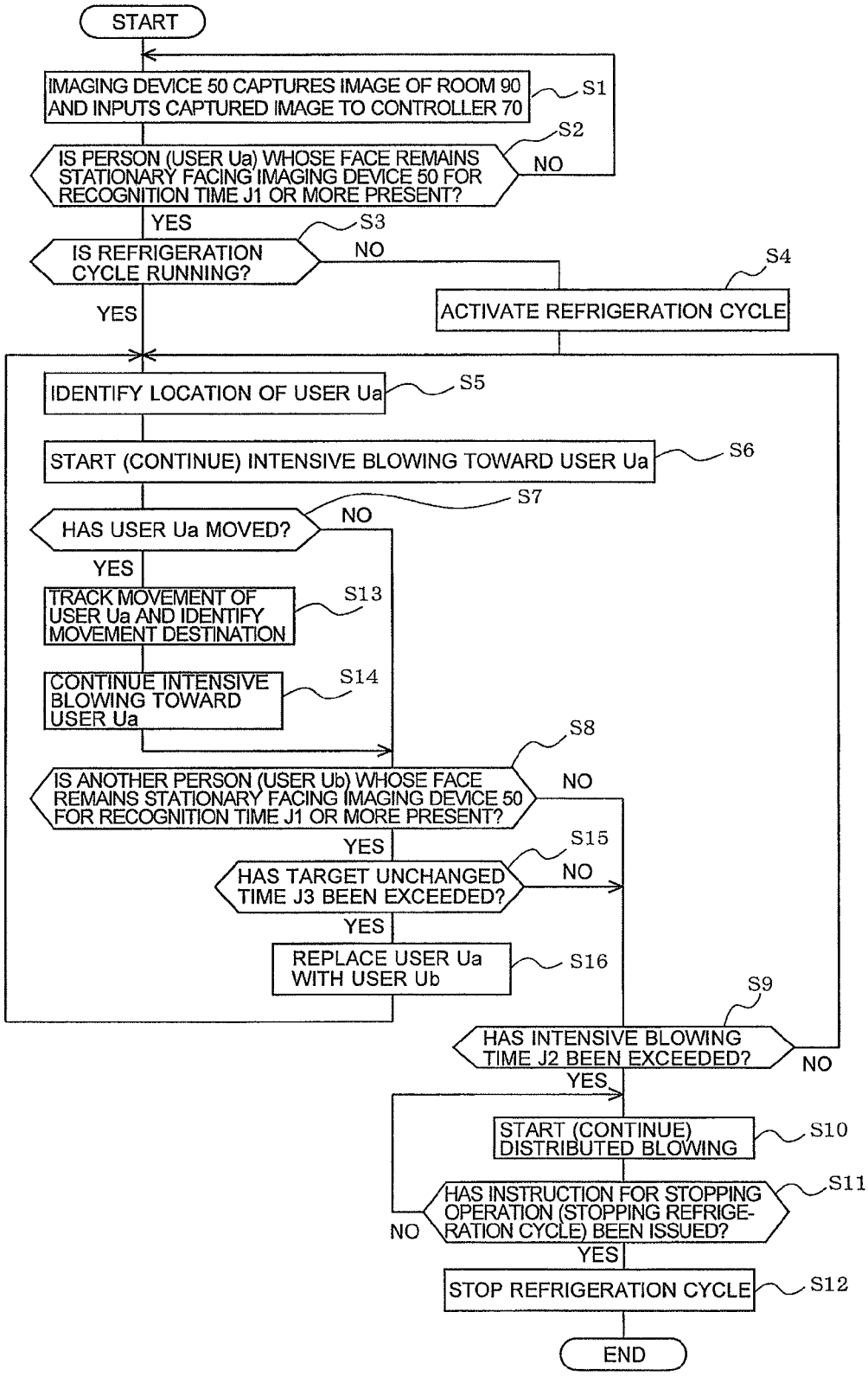
FIG. 6 is a flowchart for illustrating control steps by the indoor unit illustrated in FIG. 1A.

FIG. 6 is a flowchart for illustrating control steps by the indoor unit of the air-conditioning apparatus according to Embodiment 1 of the present invention.

Referring to FIG. 6, the controller 70 installed in the indoor unit 100 is configured to activate the refrigeration cycle and adjust the blowing direction of conditioned air (hereinafter, referred to as "air flow direction control), in accordance with indoor environment and a request from a user (person).

In the description provided below, a person who has entered a room (undressing room) immediately after taking a bath, a person who has just entered a room from hot (or cold) outdoors, a person who is present in a room and who wishes to temporarily and quickly feel cool (or warm), and the like will be collectively referred to as a user Ua.

When the refrigeration cycle is stopped, the user Ua needs to activate the refrigeration cycle and to cause conditioned air to be blown toward the user Ua. When the refrigeration cycle is activated, the user Ua needs to cause conditioned air to be blown toward the user Ua. Hereinafter, a description will be provided with reference to the flowchart (FIG. 6).

(Control Flow)

Referring to FIG. 6, the controller 70 performs the steps described below. The imaging device 50 always (for example, for every one second) captures an image of the room 90, and inputs the captured image to the controller 70 (S1).

The controller 70 determines, based on the captured image, whether or not one or more persons are present in the room 90, and determines whether or not the face of at least one person who is present in the room 90 remains stationarily facing the imaging device 50 for the recognition time J1 (for example, three seconds) or more (S2).

When it is determined that the face of the person remains stationarily facing the imaging device 50 for the recognition time J1 or more (S2), if the refrigeration cycle is stopped (S3), the person is determined as a person who wishes the refrigeration cycle to be activated and wishes conditioned air to be blown toward the person (hereinafter, referred to as a "user Ua"). Then, the controller 70 activates the refrigeration cycle (S4).

In contrast, when it is determined that the face of the person remains stationarily facing the imaging device 50 for the recognition time J1 or more (S2), if the refrigeration cycle is running (S3), the person is determined as a person who wishes conditioned air to be blown toward the person (hereinafter, referred to as a "user Ua", as mentioned above).

The controller 70 identifies the location of the user Ua (S5), and controls the attitude of the up/down air flow direction plate 9 and the left/right air flow direction plate 10 so that conditioned air is blown toward the user Ua (hereinafter, referred to as "intensive blowing") (S6).

When it is determined that the faces of plural persons who are present in the room remain stationarily facing the imaging device 50 for the recognition time J1 or more at the same time, a person who is located near the indoor unit 100 (imaging device 50) is referred to as a user Ua.

Then, the controller 70 determines whether the user Ua remains at the identified location in the room 90 without moving to a different location or the user Ua has moved to a different location (S7).

When the user Ua has not moved to a different location (S7), the controller 70 determines whether or not there is another person (a person different from the user Ua) whose face remains stationarily facing the imaging device 50 for the recognition time J1 or more (S8).

When there is no person (there is only the user Ua) whose face remains stationarily facing the imaging device 50 for the recognition time J1 or more, intensive blowing toward the user Ua is started (S6), and then the controller 70 determines whether or not a preset intensive blowing time J2 (for example, ten minutes) has been exceeded (S9). When the intensive blowing time J2 has not been exceeded, the controller 70 determines that the user Ua does not feel cool enough (or warm enough), and continues intensive blowing (return to S5).

In contrast, when there is no person (there is only the user Ua) whose face remains stationarily facing the imaging device 50 for the recognition time J1 or more (S8), if the intensive blowing time J2 has been exceeded (S9), the controller 70 determines that the user Ua feels cool enough (or warm enough), and controls the attitude of the up/down air flow direction plate 9 and the left/right air flow direction plate 10 so that conditioned air is blown uniformly inside the room 90 (hereinafter, referred to as "distributed blowing") (S10).

The distributed blowing continues (return to S10) until the user Ua or the person different from the user Ua operates the remote controller 80 to issue an instruction for stopping the operation (stopping the refrigeration cycle) (S11). When the instruction for stopping the refrigeration cycle is issued (S11), the controller 70 stops the refrigeration cycle (S12).

When the user Ua has moved to a different location within the room 90 (S7), the controller 70 tracks the movement of the user Ua, and identifies the location to which the user Ua has moved (movement destination) (S13). The controller 70 controls the attitude of the up/down air flow direction plate 9 and the left/right air flow direction plate 10 so that conditioned air continues to be blown toward the user Ua (the location of the user Ua) (so that intensive blowing continues) (S14). After that, similar to the case where it is determined that the user Ua has not moved to a different location, the controller 70 determines whether or not a blowing target is to be changed (whether or not a user Ub is present) (S8).

In the determination as to whether or not there is a person (a person different from the user Ua) whose face remains stationarily facing the imaging device 50 for the recognition time J1 or more, when it is determined that there is a person (a person different from the user Ua) whose face remains stationarily facing the imaging device 50 for the recognition time J1 or more (hereinafter, referred to as a "user Ub") (S8), the controller 70 starts intensive blowing toward the user Ua (S6) and then determines whether or not a preset target unchanged time J3 (a time during which a blowing target is not changed, for example, three minutes) has been exceeded (S15), in order to avoid frequently changing the blowing target for a short period of time.

When it is determined that the target unchanged time J3 has not been exceeded (S15), the controller 70 determines whether or not the user Ua feels cool enough (or warm enough) (proceed to S9).

Meanwhile, when it is determined that the target unchanged time J3 has been exceeded (S15), in order to start intensive blowing toward the user Ub (the location of the user Ub), instead of the user Ua, the controller 70 identifies the location of the user Ub, and starts intensive blowing toward the user Ub (the location of the user Ub). That is, the user Ua is replaced with the user Ub (S16), and the controller 70 proceeds to S5.

Here, the user Ub and the user Ua may be the same person. In this case, it is determined that the user Ua wishes conditioned air to continue to be blown toward the user Ua.

Even while intensive blowing continues, in the case where the user Ua or a person different from the user Ua operates the remote controller 80 to issue an instruction for stopping the operation (stopping the refrigeration cycle), the controller 70 stops the refrigeration cycle (not illustrated).

With the execution of the above-described steps by the controller 70 of the indoor unit 100, the following effects can be achieved:

(i) The user Ua is able to activate the refrigeration cycle quickly and certainly without operating the remote controller, and convenience is thus improved.

(ii) The user Ua (or the user Ub) is able to control the attitude of the up/down air flow direction plate 9 and the left/right air flow direction plate 10 so that conditioned air is blown toward the user Ua (or the user Ub) without operating the remote controller, and convenience is thus improved.

(iii) The intensive blowing time J2 is provided. Therefore, the user Ua is prevented from being excessively cooled down (or warmed up), without operating the remote controller, and comfort is thus enhanced.

(iv) When, instead of the user Ua, the user Ub wishes conditioned air to be blown toward the user Ub, the user Ub is able to cause conditioned air to be blown toward the user Ub quickly and certainly, without operating the remote controller. Thus, convenience is improved.

(v) The target unchanged time J3 is further provided, so that the blowing direction is not frequently changed for a short period of time. Thus, stable control can be achieved. Moreover, since indoor air flows according to the law of inertia which makes it difficult to frequently change the blowing direction for a short period of time, therefore providing the target unchanged time J3 prevents meaningless control to frequently change the blowing direction for a short period of time.

In the above description, intensive blowing represents air-blowing toward the user Ua. However, in the present invention, intensive blowing is not limited to the literal meaning of "air-blowing toward the user Ua". In the present invention, intensive blowing also includes air-blowing toward directions including the feet of the user Ua and a limited region where the user Ua is located (for example, the range of a sofa on which the user Ua sits). Further, "swing blowing" in which air is intermittently blown toward the direction of the user Ua and the other directions is possible, and the time during which air is blown toward the direction of the user Ua or the amount of air blown toward the direction of the user Ua may be longer or larger than the time during which air is blown toward the other directions or the amount of air blown toward the other directions.

At a time immediately after air blowing starts, the air flow of the blown conditioned air can be regarded as a flux having a cross-section substantially the same as the size of the air outlet and having a substantially uniform flow velocity. However, the conditioned air spreads while mixing with surrounding air in the room 90. Therefore, at a time when the conditioned air actually reaches the user Ua, the air flow has a cross-section larger than the size of the air outlet. Further, also in the cross-section, the air flow becomes a flux aggregation of different flow directions and different flow velocities. Thus, "intensive blowing" in the present invention means that the center of the averaged spread air flow "is directed toward a specific location" and conditioned air reaches also around the location of the user Ua.

Embodiment 2

Figure 7:
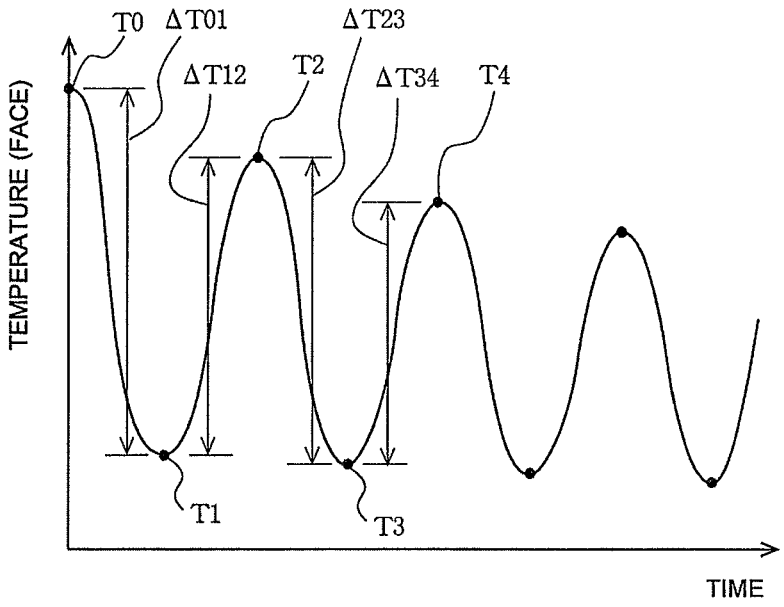
FIG. 7 is a temperature variation diagram schematically illustrating variations in the temperature by swing blowing, for illustrating an indoor unit of an air-conditioning apparatus according to Embodiment 2 of the present invention.
Figure 8:
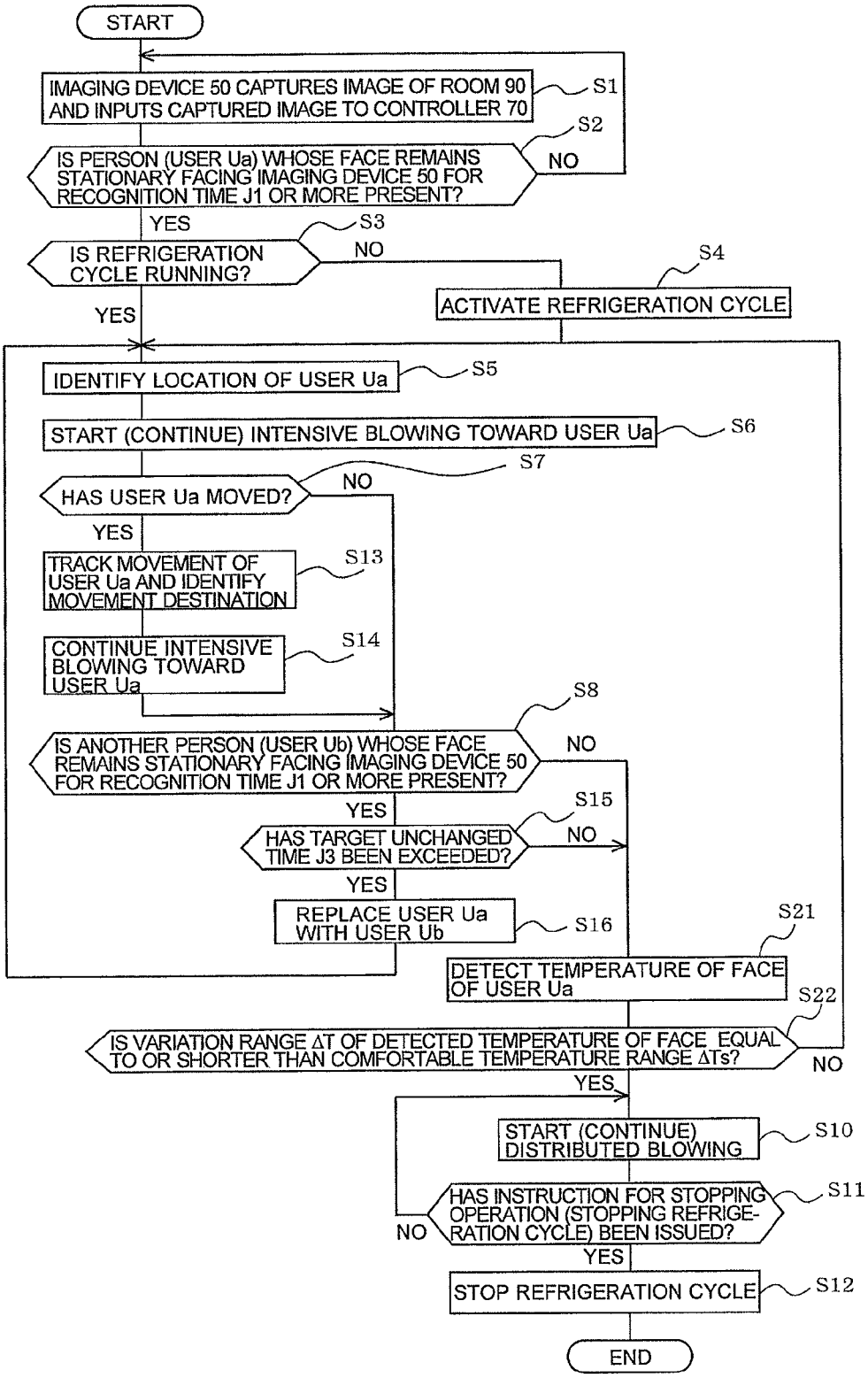
FIG. 8 is a flowchart for illustrating control steps by the indoor unit of the air-conditioning apparatus according to Embodiment 2 of the present invention.

FIGS. 7 and 8 illustrate an indoor unit of an air-conditioning apparatus according to Embodiment 2 of the present invention. FIG. 7 is a temperature variation diagram schematically illustrating variations in temperature by swing blowing, and FIG. 8 is a flowchart for illustrating control steps. The portions that are the same as or equivalent to portions in Embodiment 1 will be referred to with the same signs, and the steps that are the same as or equivalent to steps in Embodiment 1 will be referred to with the same numbers. Description of Embodiment 2 will be partially omitted.

The indoor unit of the air-conditioning apparatus (hereinafter, referred to as an "indoor unit") 200 is configured to intermittently and repeatedly change the amount of air or the air speed of conditioned air blown toward the user Ua in intensive blowing performed by the indoor unit 100 (Embodiment 1) (hereinafter, referred to as "swing intensive blowing") and include a temperature detection unit (a temperature sensor, not illustrated) capable of detecting the temperature of the face of the user Ua exposed to swing intensive blowing.

(Variations in Temperature of Face)

FIG. 7 schematically illustrates variations in the temperature of the face of the user Ua by swing intensive blowing. Referring to FIG. 7, when the surface temperature of the face immediately after starting swing intensive blowing is a temperature T0, the surface temperature of the face decreases to a temperature T1 by the first blowing toward the face (the initial air amount or air speed). When the blowing toward the face is interrupted (more accurately, the air amount or air speed decreases (including decreases to zero), the surface of the face recovers heat, and the surface temperature thus increases to a temperature T2. Then, by the second blowing toward the face (the initial air amount of air speed), the surface temperature of the face decreases to a temperature T3. When the intensive blowing toward the face is interrupted (more accurately, the air amount or air speed decreases (including decreases to zero), the surface temperature increases to a temperature T4. Subsequently, by the above-mentioned intermittent repetition of blowing, the surface temperature of the face at the time of blowing and the surface temperature of the face after recovering heat gradually decrease.

Here, the degree of decrease in the surface temperature of the face after recovering heat by repetitive swing intensive blowing (the difference between the temperature T2 and the temperature T4, etc.) is greater than the degree of decrease in the surface temperature of the face at the time of blowing by repetitive swing intensive blowing (the difference between the temperature T1 and the temperature T3, etc.).

Accordingly, the amount of decrease ΔT01 in the surface temperature of the face by the first blowing (the difference between the temperature T0 and the temperature T1), the amount of increase ΔT12 in the surface temperature of the face by the first heat recovery (the difference between the temperature T2 and the temperature T1), the amount of decrease ΔT23 in the surface temperature of the face by the second blowing (the difference between the temperature T3 and the temperature T2), and the amount of increase ΔT34 in the surface temperature of the face by the second heat recovery (the difference between the temperature T4 and the temperature T3) gradually decrease in that order.

When the amount of decrease ΔT01, ΔT23, or the like in the surface temperature of the face by intensive blowing or the amount of increase ΔT12, ΔT34, or the like in the surface temperature of the face by heat recovery (hereinafter, referred to as a "variation range ΔT of body temperature") reaches a preset comfortable temperature range ΔTs (for example, 1 degree Centigrade) or below, it is considered that the user Ua feels fresh (feels "cool enough" or "warm enough").

(Control Flow)

Referring to FIG. 8, in the case where swing intensive blowing is performed, the indoor unit 200 changes swing intensive blowing into distributed blowing in accordance with a change in the surface temperature of the face of the user Ua. The steps other than the above-mentioned feature are the same as those for the indoor unit 100. Features different from the steps for the indoor unit 100 will be described below.

That is, the controller 70 of the indoor unit 200 identifies the location of the user Ua (S5), and controls the attitude of the up/down air flow direction plate 9 and the left/right air flow direction plate 10 so that conditioned air is blown toward the user Ua for a longer period of time and with a larger amount (swing intensive blowing) (S6).

While swing intensive blowing toward the user Ua continues, the temperature detection unit detects the temperature of the face of the user Ua (S21). The controller 70 calculates the variation range ΔT of body temperature based on plural values of the detected temperature of the face, and compares the obtained variation range ΔT with the comfortable temperature range ΔTs (S22).

When the obtained variation range ΔT reaches the comfortable temperature range ΔTs or below, it is considered that the user Ua feels fresh (feels cool enough or feels warm enough), and air blowing is shifted to distributed blowing (S10). Meanwhile, during the period until the obtained variation range ΔT has exceeded the comfortable temperature range ΔTs, it is considered that the user Ua does not feel fresh (does not feel cool enough or feel warm enough), and swing intensive blowing continues (return to S5).

As described above, the temperature of the face is actually detected, and it is determined, based on the detected temperature of the face, whether or not the user Ua feels fresh. Therefore, a more appropriate timing for shifting to distributed blowing can be attained. Thus, comfort is further enhanced.

In the above description, shifting to distributed blowing is performed. However, the present invention is not limited to this, and the refrigeration cycle (operation) may be stopped.

Next, a supplementary description about the variation range ΔT of body temperature will be provided. The variation range ΔT of body temperature may be the amount of decrease in the surface temperature of a face by intensive blowing at a repetition time (in the example of the first time, ΔT=ΔT01=T0−T1), the amount of increase in the surface temperature of the face by heat recovery (in the example of the first time, ΔT=ΔT12=T2−T1), or the average of the amount of decrease in the surface temperature of a face by intensive blowing and the amount of increase in the surface temperature of the face by heat recovery (ΔT=(ΔT01+ΔT12)/2). Further, the variation range ΔT of body temperature may be the average of the amounts of decreases in the surface temperature of a face by plural intensive blowing times and the amounts of increases in the surface temperature of the face by plural heat recovery times (in the example of the first and second times, ΔT=(ΔT01+ΔT12+ΔT23+ΔT34)/4. With the use of the average of the plural amounts of decreases and the plural amounts of increases, a determination in which the influence of variations in the actual surface temperature and temperature detection is suppressed, can be attained.

Embodiment 3

Figure 9A:
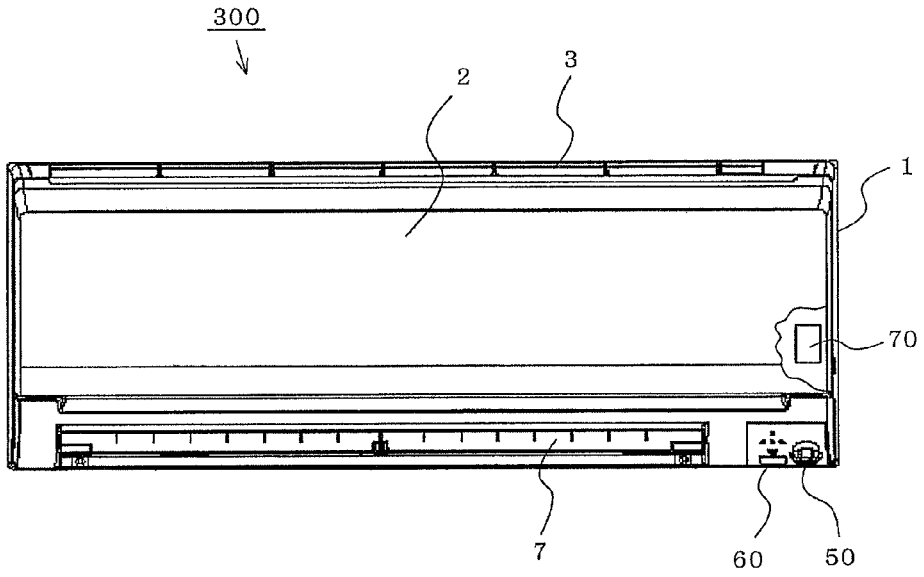
FIG. 9A is a front view for explaining an indoor unit of an air-conditioning apparatus according to Embodiment 3 of the present invention, and shows a main body.
Figure 9B:
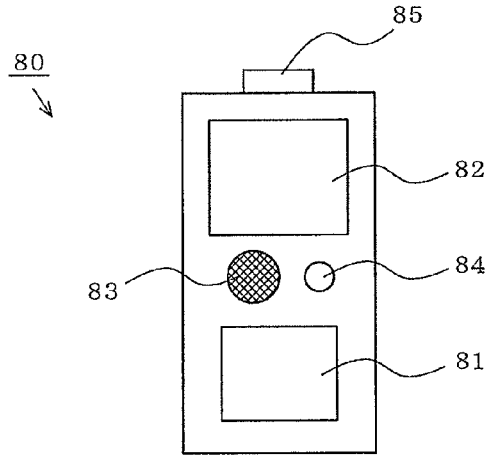
FIG. 9B is a front view for explaining the indoor unit of the air-conditioning apparatus according to Embodiment 3 of the present invention, and shows a remote controller.
Figure 10:
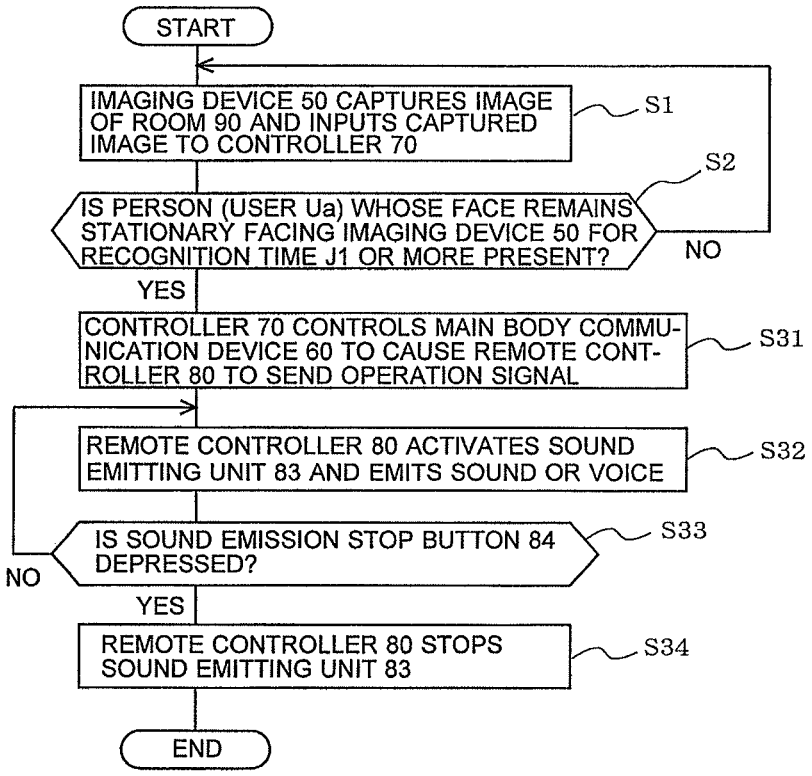
FIG. 10 is a flowchart for illustrating control steps by the indoor unit of the air-conditioning apparatus according to Embodiment 3 of the present invention.

FIGS. 9 and 10 illustrate an indoor unit of an air-conditioning apparatus according to Embodiment 3 of the present invention. FIG. 9A is a front view of the main body, FIG. 9B is a front view of a remote controller, and FIG. 10 is a flowchart for illustrating control steps. The portions that are the same as or equivalent to portions in Embodiment 1 will be referred to with the same signs, and the steps that are the same as or equivalent to steps in Embodiment 1 will be referred to with the same numbers. Description of Embodiment 3 will be partially omitted. These figures are schematically rendered, and the present invention is not limited to the illustrated forms.

(Main Body and Remote Controller)

Referring to FIG. 9A, an indoor unit of an air-conditioning apparatus (hereinafter, referred to as an "indoor unit") 300 has a configuration similar to the indoor unit 100.

Referring to FIG. 9B, the remote controller 80 provided in the indoor unit 300 includes a sound emitting unit 83 that emits a sound or voice and a sound emission stop button 84 for stopping sound emission by the sound emitting unit 83.

(Control Flow)

Referring to FIG. 10, the controller 70 of the indoor unit 300 performs the steps described below. First, the imaging device 50 always (for example, for every one second) captures an image of the room 90, and inputs the captured image to the controller 70 (S1).

The controller 70 determines, based on the captured image, whether or not one or more persons are present in the room 90, and determines whether or not the face of at least one person who is present in the room 90 remains stationarily facing the imaging device 50 for the recognition time J1 (for example, three seconds) or more (S2).

When it is determined that the face of the person remains stationarily facing the imaging device 50 for the recognition time J1 or more (S2), the person is determined as a person (hereinafter, referred to as a "user Ua") who wishes to know the location of the remote controller 80, and the controller 70 controls the main body communication device 60 to send an operation signal toward the remote controller 80 (S31).

When the communication unit 85 of the remote controller 80 receives the operation signal, the sound emitting unit 83 is activated and emits a sound (a beep, a chime, etc.) or a voice (for example, "You can find the remote controller here.") (S32).

Such a sound or voice continues to be emitted until the user Ua finds the remote controller 80 and depresses the sound emission stop button 84 (S33). When the sound emission stop button 84 is depressed, the sound emitting unit 83 is stopped (S34).

As describe above, even when the user Ua does not know the location of the remote controller 80 (whereabouts), the user Ua is able to learn the location of the remote controller 80 (whereabouts) from the sound or voice emitted from the remote controller 80. That is, since a particular operation is not required, the user Ua is able to find the remote controller 80 easily and quickly. Thus, convenience is further improved.

Furthermore, the above-mentioned series of steps (S31 to S34) may be applied to the indoor units 100 and 200 (Embodiments 1 and 2) such that in the control flows for the indoor units 100 and 200, after the step (S2) for determining whether or not the face of a person remains stationarily facing the imaging device 50 for the recognition time J1 or more, the series of steps (S31 to S34) may be performed concurrently with the subsequent steps (S3 to S7). Further, after the step (S8) for determining whether or not there is a person (a person different from the user Ua) whose face remains stationarily facing the imaging device 50 for the recognition time J1 or more, the series of steps (S31 to S34) may be performed concurrently with the subsequent steps.

Embodiment 4

Figure 11A:
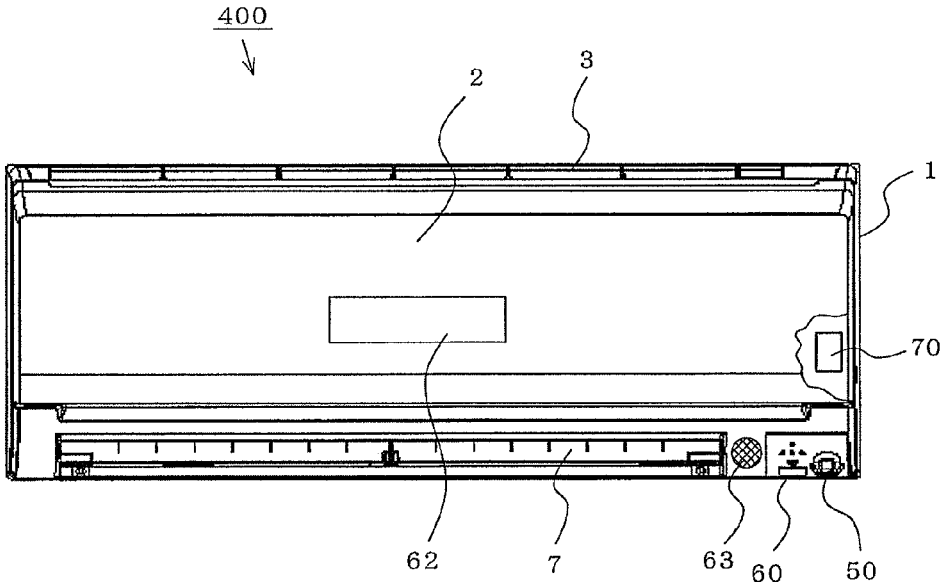
FIG. 11A is a front view for explaining an indoor unit of an air-conditioning apparatus according to Embodiment 4 of the present invention, and shows a main body.
Figure 11B:
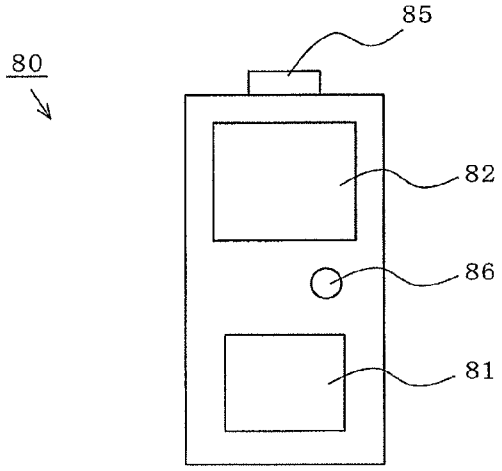
FIG. 11B is a front view for explaining the indoor unit of the air-conditioning apparatus according to Embodiment 4 of the present invention, and shows a remote controller.
Figure 12:
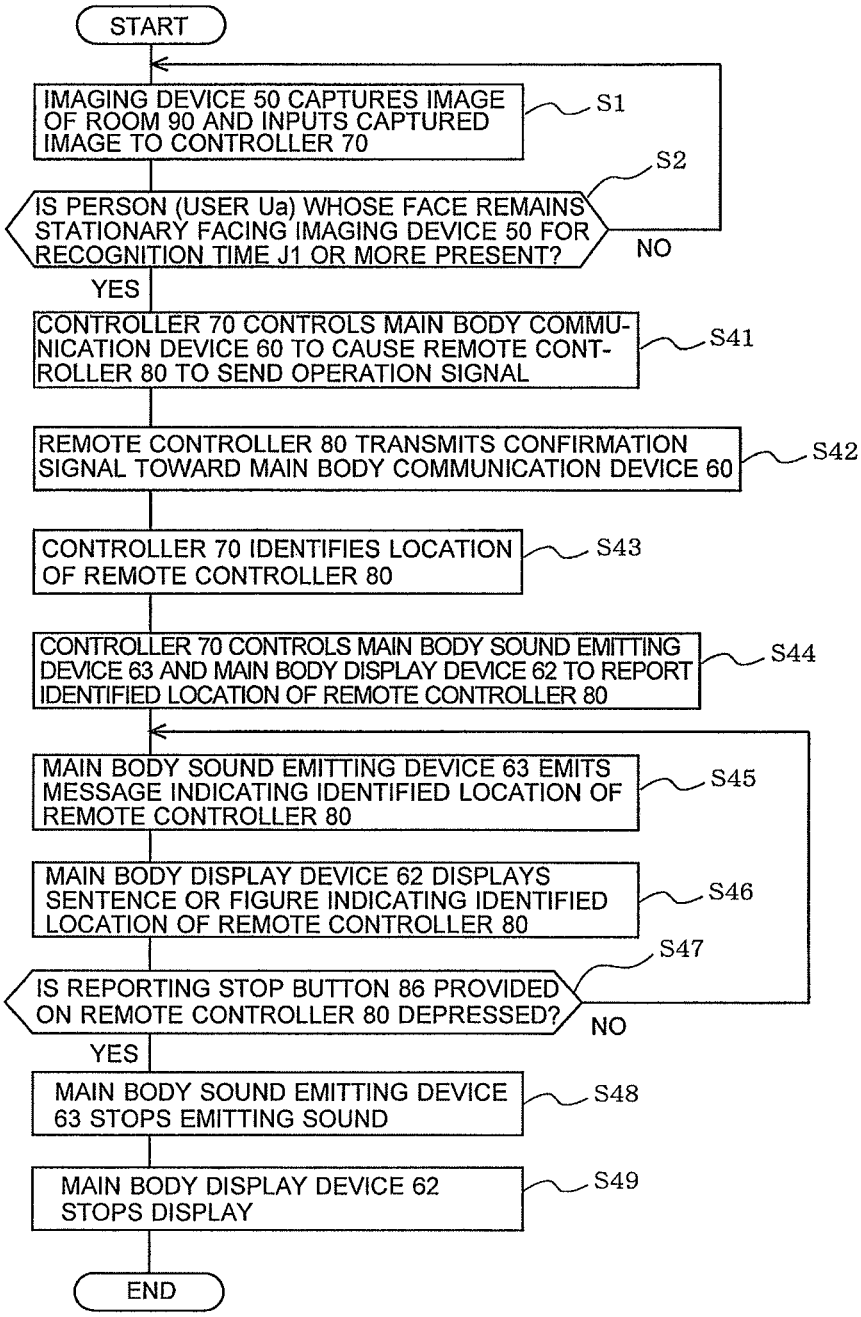
FIG. 12 is a flowchart for illustrating control steps by the indoor unit of the air-conditioning apparatus according to Embodiment 4 of the present invention.

FIGS. 11 and 12 illustrate an indoor unit of an air-conditioning apparatus according to Embodiment 4 of the present invention. FIG. 11A is a front view of the main body, FIG. 11B is a front view of a remote controller, and FIG. 12 is a flowchart for illustrating control steps. The portions that are the same as or equivalent to portions in Embodiment 1 will be referred to with the same signs, and the steps that are the same as or equivalent to steps in Embodiment 1 will be referred to with the same numbers. Description of Embodiment 4 will be partially omitted. These figures are schematically rendered, and the present invention is not limited to the illustrated forms.

(Main Body and Remote Controller)

Referring to FIG. 11A, an indoor unit of an air-conditioning apparatus (hereinafter, referred to as an "indoor unit") 400 is configured to allow a person (user) to know the location of the remote controller 80. The main body 1 includes a main body sound emitting device 63 that is provided on the front side of the main body 1 and beside the main body communication device 60 and that emits a sound (a voice, electronic sound, etc.), and a main body display device 62 that is provided at substantially the center of the front panel 2 and that displays, thereon by emerging, characters, signs, patterns, or the like. Light is projected to the main body display device 62 from inside the main body 1. However, in the present invention, the form of the main body display device 62 and the way of display are not limited.

Referring to FIG. 11B, the remote controller 80 (see FIG. 1B) provided in the indoor unit 100 includes a reporting stop button 86.

(Control Flow)

Referring to FIG. 12, first, the controller 70 of the indoor unit 400 always (for example, for every one second) determines, based on an image captured by the imaging device 50, whether or not one or more persons are present in the room 90 (S1), and determines whether or not the face of at least one person who is present in the room 90 remains stationarily facing the imaging device 50 for the recognition time J1 (for example, three seconds) or more (S2). When the controller 70 determines that the face of the person remains stationarily facing the imaging device 50 for the recognition time J1 or more (S2), the person is determined as a person (hereinafter, referred to as a "user Ua") who wishes to know the location of the remote controller 80, and the controller 70 controls the main body communication device 60 to send a search signal (equal to an operation signal) toward the remote controller 80 (S41).

When the communication unit 85 receives the search signal, the remote controller 80 transmits a confirmation signal toward the main body communication device 60 (S42).

Meanwhile, when the main body communication device 60 receives the confirmation signal, the controller 70 identifies the location of the remote controller 80, based on the confirmation signal (S43), and controls the main body sound emitting device 63 and the main body display device 62 to report the identified location of the remote controller 80 (S44).

The main body sound emitting device 63 emits a voice, such as a message indicating the identified location of the remote controller 80, for example, "The remote controller is located on the right hand side at the further end of the room." (S45), and the main body display device 62 displays a sentence or figure indicating the identified location of the remote controller 80, for example, a sentence, such as "The remote controller is located on the left hand side near the main body.", or a figure, such as "an arrow indicating a right direction" (S46).

Such a sound or voice continues to be emitted and such a sentence or figure continues to be displayed until the user Ua finds the remote controller 80 and depresses the reporting stop button 86 (S47). When the reporting stop button 86 is depressed, the main body sound emitting device 63 stops emitting a sound (S48), and the main body display device 62 stops display (S49).

As described above, with the indoor unit 400, even when the user Ua does not know the location of the remote controller 80 (whereabouts), the user Ua is able to find the remote controller 80 easily and quickly based on information reported from the main body 1. Thus, convenience is further improved.

In the above description, the main body 1 is provided with both the main body sound emitting device 63 and the main body display device 62. However, the present invention is not limited to this. Only one of the main body sound emitting device 63 and the main body display device 62 may be provided.

Further, by application to the indoor unit 300 (Embodiment 3), the sound emitting unit 83 may be provided on the remote controller 80. When the search signal (equal to an operation signal) is received, the sound emitting unit 83 may be driven, and when the reporting stop button 86 is depressed, the sound emitting unit 83 may be stopped. Accordingly, the user is able to learn the location of the remote controller 80 (whereabouts) from both the main body 1 and the remote controller 80.

Furthermore, the above-mentioned series of steps (S41 to S49) may be applied to the indoor units 100 and 200 (Embodiments 1 and 2) such that in the control flows for the indoor units 100 and 200, after the step (S2) for determining whether or not the face of a person remains stationarily facing the imaging device 50 for the recognition time J1 or more, the series of steps (S41 to S49) may be performed concurrently with the subsequent steps (S3 to S7). Further, after the step (S8) for determining whether or not there is a person (a person different from the user Ua) whose face remains stationarily facing the imaging device 50 for the recognition time J1 or more, the series of steps (S41 to S49) may be performed concurrently with the subsequent steps.

The invention claimed is:

1. An indoor unit of an air-conditioning apparatus comprising:

a heat exchanger that performs part of a refrigeration cycle; a fan that flows air conditioned at the heat exchanger; an air flow direction adjusting device that adjusts a blowing direction of the conditioned air blown by the fan; an imaging device that captures an image of a room; and a controller that controls at least the refrigeration cycle, based on information of a person whose image is captured by the imaging device, wherein the controller is configured to when the refrigeration cycle is stopped, responsive to a determination that a face of the person whose image is captured by the imaging device remains stationarily facing the imaging device for a preset recognition time, activate the refrigeration cycle;

after activating the refrigeration cycle responsive to the determination that the face of the person remains stationarily facing the imaging device for the preset recognition time:

identify a location of the person and control the air flow direction adjusting device so that the conditioned air is blown toward the identified location of the person for a preset intensive blowing time, and responsive to a determination that (i) a face of another person whose image is captured by the imaging device remains stationarily facing the imaging device for the preset recognition time while the conditioned air is blown toward the identified location of the person and (ii) a time during which the air flow direction adjusting device is controlled so that the conditioned air is blown toward the identified location of the person exceeds a preset-target-unchanged-time that is shorter than the preset intensive blowing time, identify a location of the other person and control the air flow direction adjusting device to intensively blow the conditioned air stationarily toward the identified location of the other person for the preset intensive blowing time.

2. An indoor unit of an air-conditioning apparatus comprising:

a heat exchanger that performs part of a refrigeration cycle; a fan that blows air conditioned at the heat exchanger; an air flow direction adjusting device that adjusts a blowing direction of the conditioned air blown by the fan; an imaging device that captures an image of a room; and a controller that controls at least the air flow direction adjusting device, based on information of a person whose image is captured by the imaging device, wherein the controller is configured to when the refrigeration cycle is running, responsive to a determination that a face of the person whose image is captured by the imaging device remains stationarily facing the imaging device for a preset recognition time, identify a location of the person, and control the air flow direction adjusting device so that the conditioned air is blown toward the identified location of the person for a preset intensive blowing time, responsive to a determination that (i) a face of another person whose image is captured by the imaging device remains stationarily facing the imaging device for the preset recognition time while the conditioned air is blown toward the identified location of the person and (ii) a time during which the air flow direction adjusting device is controlled so that the conditioned air is blown toward the identified location of the person exceeds a preset-target-unchanged-time that is shorter than the preset intensive blowing time, identify a location of the other person and control the air flow direction adjusting device to intensively blow the conditioned air stationarily toward the identified location of the other person for the preset intensive blowing time.

3. The indoor unit of the air-conditioning apparatus of claim 1, wherein when controlling the air flow direction adjusting device so that the conditioned air is blown toward the identified location of the person, the controller controls the air flow direction adjusting device so that the conditioned air is intermittently blown also toward directions other than a direction of the identified location of the person.

4. The indoor unit of the air-conditioning apparatus of claim 1, responsive to a determination that the time during which the air flow direction adjusting device is controlled so that the conditioned air is blown toward the identified location of the person exceeds a preset intensive blowing time, the controller controls the air flow direction adjusting device so that the conditioned air is blown uniformly inside the room.

5. The indoor unit of the air-conditioning apparatus of claim 1, further comprising:

a temperature detection unit for detecting a body temperature of the person whose image is captured by the imaging device, wherein when a variation range of the body temperature of the person reaches a preset comfortable temperature range or below after the body temperature of the person detected by the temperature detection unit increases and decreases repeatedly, the controller performs at least one of controlling the air flow direction adjusting device so that the conditioned air is blown uniformly inside the room or stopping the refrigeration cycle.

6. The indoor unit of the air-conditioning apparatus of claim 1, wherein in a case where the person has moved after the air flow direction adjusting device is controlled so that the conditioned air is blown toward the identified location of the person, the controller identifies a movement destination of the person by tracking movement of the person and controls the air flow direction adjusting device so that the conditioned air is blown toward the identified movement destination.

7. The indoor unit of the air-conditioning apparatus of claim 6, wherein when controlling the air flow direction adjusting device so that the conditioned air is blown toward the identified movement destination, the controller controls the air flow direction adjusting device so that the conditioned air is intermittently blown also toward directions other than a direction of the identified movement destination.

8. The indoor unit of the air-conditioning apparatus of claim 5, wherein after the person has moved and controlling the air flow direction adjusting device so that the conditioned air is blown toward the identified movement destination is started, when a preset intensive blowing time is exceeded without the person moving, the controller controls the air flow direction adjusting device so that the conditioned air is blown uniformly inside the room.

9. The indoor unit of the air-conditioning apparatus of claim 1, further comprising:

a remote controller, wherein when activating the refrigeration cycle, the controller sends an operation signal toward the remote controller, and wherein when receiving the operation signal, the remote controller emits at least one of a sound, light, or vibration.

10. The indoor unit of the air-conditioning apparatus of claim 2, further comprising:

a remote controller, wherein when controlling the air flow direction adjusting device so that the conditioned air is blown toward the identified location of the person, the controller sends an operation signal toward the remote controller, and wherein when receiving the operation signal, the remote controller emits at least one of a sound, light, or vibration.

11. The indoor unit of the air-conditioning apparatus of claim 9, wherein when receiving the operation signal, the remote controller sends a confirmation signal toward the controller, and wherein when receiving the confirmation signal, the controller determines a location of the remote controller, based on the confirmation signal, and reports the determined location of the remote controller using a sound or display.

12. The indoor unit of the air-conditioning apparatus of claim 2, wherein when controlling the air flow direction adjusting device so that the conditioned air is blown toward the identified location of the person, the controller controls the air flow direction adjusting device so that the conditioned air is intermittently blown also toward directions other than a direction of the identified location of the person.

13. The indoor unit of the air-conditioning apparatus of claim 2, wherein when a time during which the air flow direction adjusting device is controlled so that the conditioned air is blown toward the identified location of the person exceeds a preset intensive blowing time, the controller controls the air flow direction adjusting device so that the conditioned air is blown uniformly inside the room.

14. The indoor unit of the air-conditioning apparatus of claim 2, further comprising:

a temperature detection unit for detecting a body temperature of the person whose image is captured by the imaging device, wherein when a variation range of the body temperature of the person reaches a preset comfortable temperature range or below after the body temperature of the person detected by the temperature detection unit increases and decreases repeatedly, the controller performs at least one of controlling the air flow direction adjusting device so that the conditioned air is blown uniformly inside the room or stopping the refrigeration cycle.

15. The indoor unit of the air-conditioning apparatus of claim 2, wherein in a case where the person has moved after the air flow direction adjusting device is controlled so that the conditioned air is blown toward the identified location of the person, the controller identifies a movement destination of the person by tracking movement of the person and controls the air flow direction adjusting device so that the conditioned air is blown toward the identified movement destination.

16. The indoor unit of the air-conditioning apparatus of claim 6, wherein after the person has moved and controlling the air flow direction adjusting device so that the conditioned air is blown toward the identified movement destination is started, when a preset intensive blowing time is exceeded without the person moving, the controller controls the air flow direction adjusting device so that the conditioned air is blown uniformly inside the room.

17. The indoor unit of the air-conditioning apparatus of claim 10, wherein when receiving the operation signal, the remote controller sends a confirmation signal toward the controller, and wherein when receiving the confirmation signal, the controller determines a location of the remote controller, based on the confirmation signal, and reports the determined location of the remote controller using a sound or display.

* * * * *